United States Patent [19]

Tomlinson

[11] 3,997,987

[45] Dec. 21, 1976

[54] BACKHOE

[76] Inventor: Audie B. Tomlinson, Rte. 1, Box 215, Cove, Oreg. 97824

[22] Filed: June 20, 1975

[21] Appl. No.: 588,703

[52] U.S. Cl. ..... 37/103; 214/138 R; 214/140; 214/768

[51] Int. Cl.[2] ..... E02F 5/02

[58] Field of Search ..... 37/103, 117.5, DIG. 7; 214/131–133, 137, 138 R, 138 C, 140, 142, 145, 146.5, 147, 762, 763, 768, 769, 774, 778

[56] References Cited

UNITED STATES PATENTS

| | | | |
|---|---|---|---|
| 2,411,498 | 11/1946 | Billings | 214/138 R |
| 2,718,718 | 9/1955 | Bartlett | 214/140 X |
| 2,878,951 | 3/1959 | Pilch | 214/132 X |
| 3,087,636 | 4/1963 | Weaver | 214/131 X |
| 3,220,578 | 11/1965 | Pilch | 214/138 R |
| 3,247,986 | 4/1966 | Eyler et al. | 214/138 R |
| 3,425,572 | 2/1969 | Brach | 214/140 X |
| 3,653,131 | 4/1972 | Pilch | 214/138 R |
| 3,776,403 | 12/1973 | Billings | 214/137 |
| 3,871,538 | 3/1975 | Miller et al. | 214/146.5 X |
| 3,881,612 | 5/1975 | Wells | 214/768 X |

FOREIGN PATENTS OR APPLICATIONS

| | | | |
|---|---|---|---|
| 294,429 | 9/1965 | Australia | 37/103 |
| 677,645 | 1/1964 | Canada | 214/140 |
| 647,932 | 9/1962 | Canada | 37/103 |
| 1,071,311 | 10/1958 | Germany | 214/132 |
| 196,097 | 2/1958 | Switzerland | 214/140 |
| 1,049,307 | 11/1966 | United Kingdom | 37/103 |

*Primary Examiner*—E.H. Eickholt
*Attorney, Agent, or Firm*—Klarguist, Sparkman, Campbell, Leigh, Hall & Whinston

[57] ABSTRACT

A backhoe has a main boom mounting a short shaft in preloaded thrust bearings. A gear casing floatingly mounted on the main boom carries a worm driven by a chain-and-sprocket drive to drive a worm gear on the shaft. A jib boom fixed to the lower end of the shaft journals a yoke about one axis and a bucket is pivotal on the yoke about a transverse axis. A crowd cylinder mounted on the boom is connected by linkage and a universal joint to the bucket, and a hydraulic motor mounted in a cup-like trunnion member on the lower end of the jib boom and journaling the yoke has its drive splined to the yoke for tilting the bucket sidewise.

15 Claims, 5 Drawing Figures

BACKHOE

DESCRIPTION

This invention relates to an improved backhoe, and has for an object thereof the provision of an improved backhoe.

Another object of the invention is to provide a backhoe having a bucket pivot which is selectively adjustable for tilt.

A further object is to provide a backhoe having a power adjuster to tilt a bucket pivot.

Another object of the invention is to provide a backhoe having a bucket pivot which is selectively adjustable for tilt and a crowd cylinder drive connected to the bucket by a universal joint.

Another object of the invention is to provide a backhoe having a yoke mounting a bucket pivot and journaled on a hollow trunnion containing a hydraulic motor splined to the yoke for tilting the yoke about an axis transverse to the pivot axis of the bucket.

Another object of the invention is to provide a backhoe having a short shaft section having hydraulic passages connected to a rotary hydraulic coupling above a main boom journaling the shaft section and a jib boom rigidly connected to the lower end of the shaft section.

Another object of the invention is to provide a backhoe having a main boom mounting a pair of thrust bearings at opposite ends of a bushing with a shaft journaled in the bushing and having a shoulder engaging one thrust bearing and a preloading nut screwed onto the shaft and engaging the other thrust bearing.

Another object of the invention is to provide a backhoe having a jib shaft journaled in an end of a main boom and driven by gearing in a gear case splined to the main boom and floating thereon.

Another object of the invention is to provide a backhoe having a gear case on a main boom for driving a jib shaft and a hydraulic motor driving a chain-and-sprocket coupling to the gear case, whereby sprockets of different sizes are interchangeable to provide changes in gear ratio.

Figure 1:
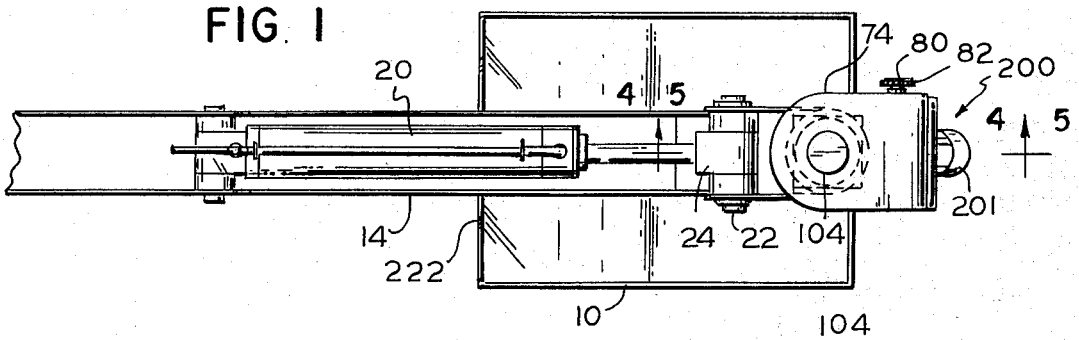
FIG. 1 is a fragmentary, top plan view of an improved backhoe forming one embodiment of the invention.
Figure 2:
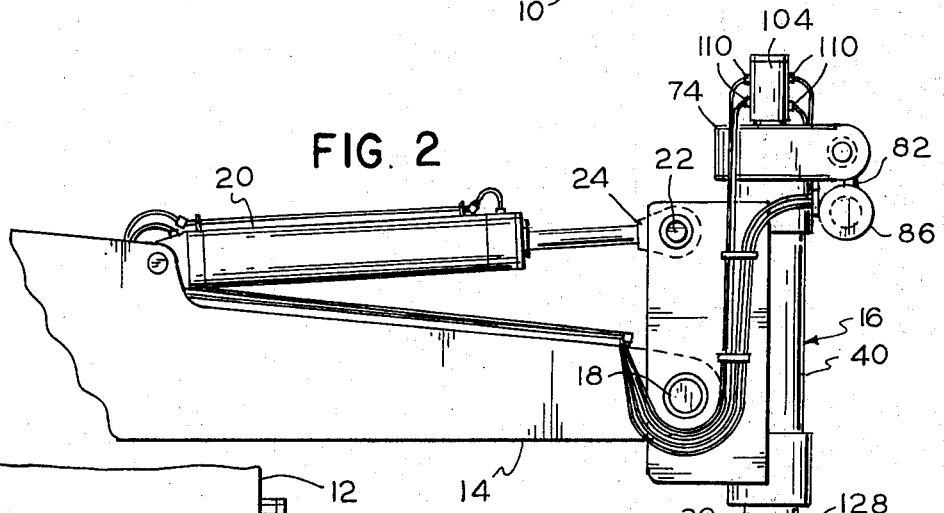
FIG. 2 is a fragmentary side elevation view of the improved backhoe of FIG. 1.
Figure 3:
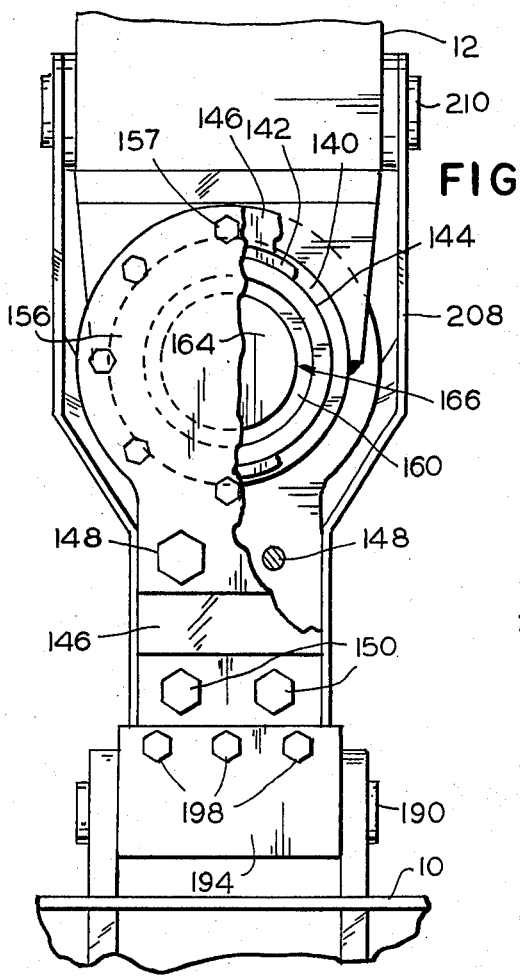
Figure 3:
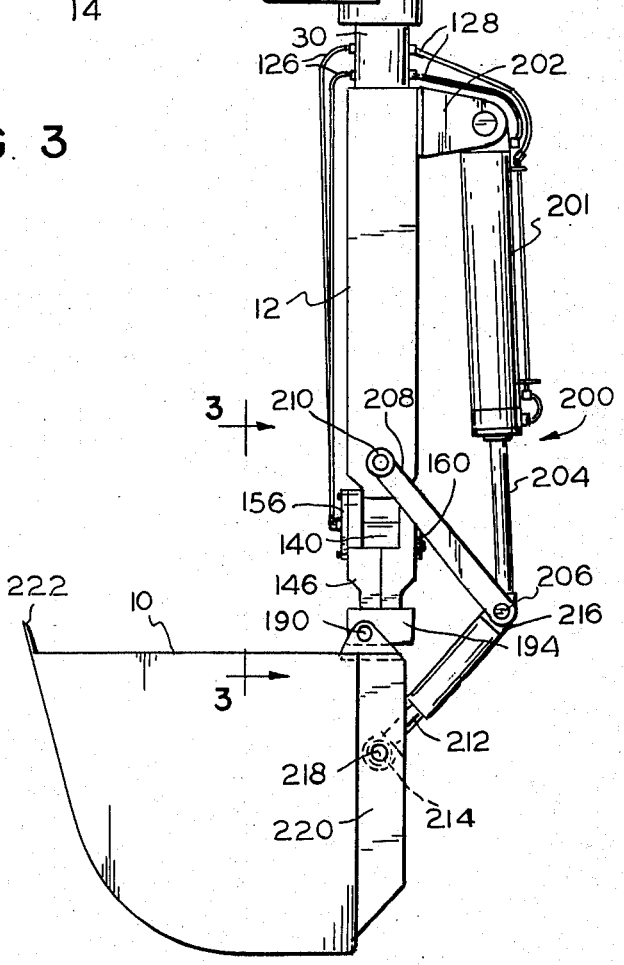
Figure 4:
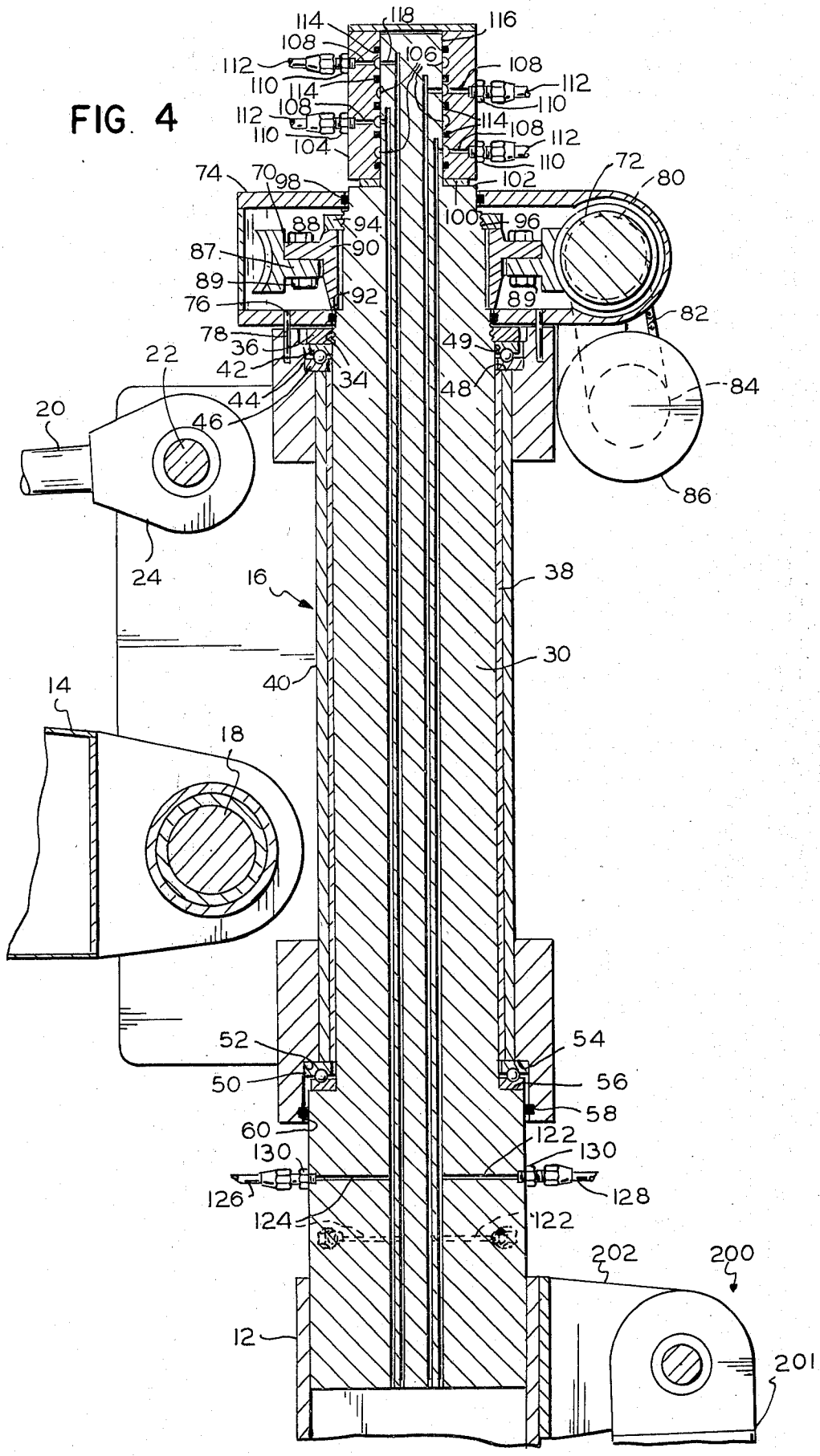
Figure 5:
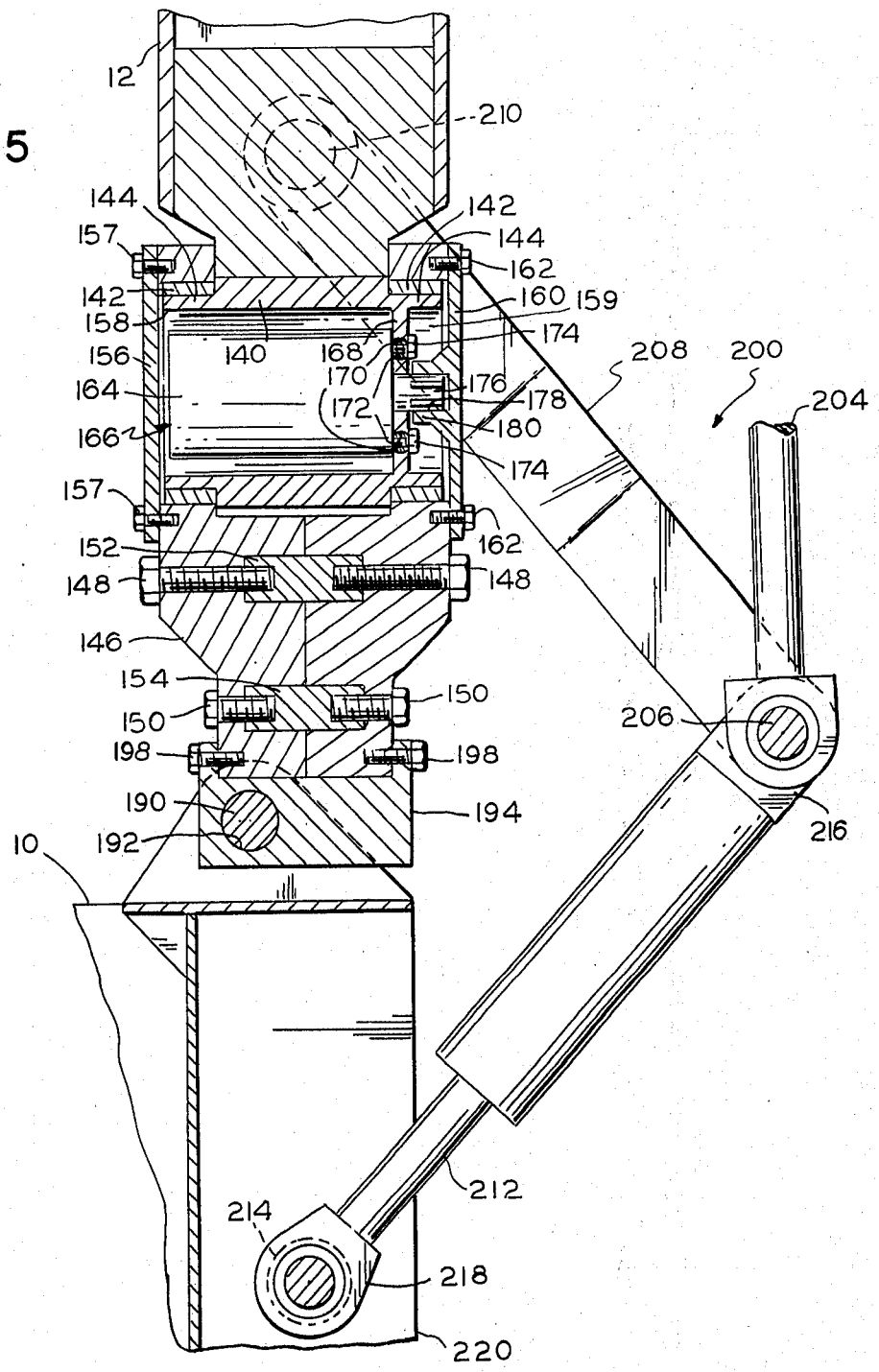

FIG. 3 is an enlarged, vertical sectional view taken along line 3—3 of FIG. 2; and, FIGS. 4 and 5 together constitute an enlarged, fragmentary, vertical sectional view taken along line 4—4 (5—5) of FIG. 1.

Referring now in detail to the drawings, there is shown therein an improved swivelled backhoe forming one embodiment of the invention and including a bucket 10 mounted for powered, limited universal movement on a jib boom 12, which is carried by and is rotatable 360° relative to a main boom 14 of the backhoe. A cylindrical housing 16 is pivotally connected by stub axles 18 to the main boom, and is pivotal on the axles by a hydraulic cylinder drive 20 pivotally connected to the upper end of the housing by a pin 22 and a clevis 24.

A stepped jib boom journal or shaft 30 fitting into and welded to the upper end portion of the jib boom 12 has a journal portion 32 having a threaded upper end portion 34 on which a nut 36 is screwed to preload the bearings. The journal portion 32 is rotatable in bushing 38 mounted in tubular end 40 of the main boom 14. The nut 36 bears on upper race 42 of upper thrust bearing 44, lower race 46 thereof bearing on shoulder 48 of counterbore 49 in the tubular end 40. A lower thrust bearing 50 is mounted in lower counterbore 52 in the tubular end 40 between shoulder 54 of the counterbore 52 and shoulder 56 of the journal 30. A rotary seal 58 is positioned in a counterbore 60 between the tubular end 40 and the journal 30.

A worm gear 70 is selectively rotatable in opposite directions by a worm 72 journaled in gear housing 74 splined to the tubular end 40 of the main boom by dowels 76 fitting into bores 78 in the end 40, the dowels providing a floating connection. The worm 72 is driven by sprocket 80, chain 82, sprocket 84, and reversible hydraulic motor 86 mounted on the main boom. The sprockets 80 and 84 are removable and may be replaced with sprockets different in sizes therefrom to change the gear ratio. The worm gear 70 has an inner annular flange 87 secured by bolts 89 to annular flange 88 of hub 90 splined to the journal 30 and held against shoulder 92 of the journal by nut 94 screwed onto threaded portion 96 of the journal. A rotary seal 98 seals the journal to the upper end of the gear housing 74, which is kept full of grease. If desired, a high torque, low speed hydraulic vane motor can be used to adjust and hold in adjustment the journal 30, the motor being splined directly to the journal.

A thrust washer 100 on upper shoulder 102 of the journal 30 supports a rotary coupling sleeve 104, which is mounted on the gear housing 74. The sleeve has two pairs of annular grooves 106 which are connected by lateral bores 108 to fittings 110 connected by hoses 112 to two four-way valves (not shown) under the control of the operator of the backhoe. The valves are connected to the pump and the reservoir for selectively connecting the grooves to the pump and the reservoir. Rotary seals 114 in grooves in the sleeve engage reduced end portion 116 of the journal. The grooves 106 connect the lateral bores 108 to lateral bores 118 connected to two pairs of blind bores 120 in the journal, the bores 120 being plugged at their lower ends and being connected by pairs of lateral bores 122 and 124 to two pairs of hoses 126 and 128 by fittings 130 and 132. Thus, the sleeve 104 and journal 30 serve as a rotary coupling to the two pairs of hydraulic lines or hoses 126 and 128.

To provide sidewise or tilt adjustment of the bucket 10 a cup-like motor mounting trunnion member 140 is welded and partially strapped to the lower end of the jib boom 12, and carries two bushings 142 on boss-like end portions 144 thereof. Halves of a split yoke 146 secured together by capscrews 148 and 150 and internally threaded dowels 152 and 154 are journaled on the bushings 142. A cover 156 bolted to the yoke by capscrews 157 closes one end of counterbore 158, and a combined cover and splining plate 160 closes a short counterbore 159 at the other end of the bore and is secured to the yoke by capscrews 162, to form a sealed chamber containing grease, the bushings 142 being very close-fitting and effectively keeping out dirt and debris. A casing 164 of a hydraulic motor 166 is resiliently mounted on bottom 168 of the motor mount 140 by steel-sleeved rubber mounts 170 in sockets 172 in the bottom 168 and capscrews 174. A splined drive shaft 176 is splined in a splining socket 178 in a boss 180 in the splining plate 160. When the motor 166 is energized, it turns the yoke 146 on the bushings 142, the bushings being concentric to the motor, the motor being connected to the hydraulic lines 126 which are controlled by manually operable valves back at the cab (not shown) of the backhoe. When the motor is stopped, it holds the yoke in the position to which it has been rotated. The hydraulic lines 126 pass through holes in the central portion of the trunnion member 140 and may be sealed to the holes by grommets or the like. The bucket 10 is mounted pivotally on a pin 190 supported in bore 192 of a bucket mounting bracket 194 bolted by capscrews 198 to the yoke 146. The bore 190 is transverse to the axis of rotation of the yoke so that the bucket is universally adjustable. The bucket is pivoted on the pin 190 to and held in a desired position by a crowd cylinder drive 200 having a cylinder 201 pivoted on brackets 202 on the jib boom 12, and is supplied and exhausted by hydraulic liquid from lines 128 under the operator's control by valving (not shown) back at the cab. A piston rod 204 of the drive 200 is pivotally connected by a pin 206 carrying a self-aligning bearing 216 to links 208 pivotally mounted by pin 210 to the lower end portion of the jib boom. The bearing 216 connects an upper, link member 212 to the link 208 and the rod 204. The link member 212 is connected by a self-aligning bearing or universal joint connection 214 to a pin 218 secured to backbone 220 of the bucket. The center of the connection 214 is at the longitudinal axis of the pin portions 218 so that the link member transmits thrust without play. The connection 214 may also be a ball-and-socket connection and permits the bucket to be tilted sidewise by the motor 166 without bind from the above-described connecting structure to the crowd cylinder drive. Preferably a universal joint connection 216 is a self-aligning bearing or ball-and-socket joint. This sidewise turning adjustment or tilt enables the operator to get blade 222 of the bucket parallel to the ground or at any other desired angle regardless of the position of the cab and chassis (not shown) of the backhoe relative to the horizontal. The sidewise tilt is, of course, somewhat limited in angle, but is amply sufficient for all conditions normally encountered in such work.

What is claimed is:

1. In a backhoe,
a somewhat horizontal main boom having a vertical journaling bore,
a short shaft having longitudinal hydraulic passages therethrough,
bearing means journaling the shaft in the journaling bore,
the shaft having upper ports above the journaling bore and lower ports below the journaling bore,
a jib boom aligned with and rigidly attached at its upper end to the shaft,
bucket means mounted on the lower end of the jib boom,
indexing means mounted on the main boom for rotating the shaft in the journaling bore,
rotary coupling means connected to the upper ports,
hydraulic drive means mounted on the jib boom,
and hydraulic lines extending along the jib boom and connecting the lower ports to the drive means.

2. The backhoe of claim 1 including a worm gear on the shaft and positioned above the main boom,
a worm meshing with the worm gear,
a gear casing journaling the worm,
motor means for driving the worm gear,
and means splining the gear casing to the main boom for floating movement relative thereto.

3. The backhoe of claim 2 wherein the splining means comprises a plurality of dowels slidably mounting the gear casing on the main boom.

4. The backhoe of claim 3 wherein the shaft includes a stepped portion above the gear casing,
the rotary coupling means including a sleeve member journaled on the shaft above the gear casing,
and thrust bearing means supporting the sleeve member on the shaft.

5. The backhoe of claim 1 wherein the shaft includes a stepped portion above the main boom,
thrust bearing means on the stepped portion of the shaft,
the rotary coupling including a stationary sleeve member on the stepped portion of the shaft and supported by the thrust bearing means,
the sleeve member including vertically spaced annular grooves and lateral passages to the grooves,
and sealing means positioned between the grooves,
the upper ports in the shaft member opening into the grooves.

6. The backhoe of claim 1 wherein the main boom includes an upper counterbore and a lower counterbore concentric with the journaling bore,
a pair of thrust bearings mounted in the counterbores,
the shaft having a shoulder abutting the bearing in the lower counterbore and having a threaded portion positioned above the bearing in the upper counterbore,
a nut screwed onto the threaded portion and bearing against the thrust bearing in the upper counterbore,
and a bushing in the journaling bore and radially journaling the shaft.

7. In a backhoe,
a jib boom,
a bucket,
adjustable first universal joint means pivotally carrying the bucket for pivotal movement about a generally horizontal first axis and attached to the jib boom for pivotal movement about a second generally horizontal second axis transverse to said first axis,
first manually controlled means for pivoting the bucket about said first axis,
second manually controlled means for pivoting the universal joint means about said second axis,
the joint means including a yoke pivotally mounting the bucket on said second axis and pivotally mounted on the jib boom on said first axis,
the first manually controlled means including a crowd cylinder drive connected pivotally at one end to the jib boom, and second universal joint means connecting the crowd cylinder drive to the bucket at the other end thereof for universal movement therebetween.

8. The backhoe of claim 7 wherein the second manually controlled means includes a hydraulic motor having a case rigidly attached to the jib boom and a rotor coupled to the yoke.

9. In a backhoe,
a jib boom,
a bucket,
adjustable universal joint means pivotally carrying the bucket for pivotal movement about one axis and attached to the jib boom for pivotal movement about a second axis transverse to said one axis, first manually controlled means for pivoting the bucket about said one axis, and second manually controlled means for pivoting the universal joint means about said second axis, the joint means including a yoke pivotally mounting the bucket on said second axis and pivotally mounted on the jib boom on said one axis, the second manually controlled means including a hydraulic motor having a case rigidly attached to the jib boom and a rotor coupled to the yoke.

10. The backhoe of claim 9 including a hollow trunnion member attached to the jib boom and mounting the yoke pivotally on said second axis, means fixing the case to the trunnion member in the hollow trunnion member, and means keying the rotor to the yoke.

11. The backhoe of claim 10 wherein the trunnion member has a cup portion, the case being positioned in the cup portion and secured to the bottom of the cup portion, the rotor extending through the bottom of the cup portion.

12. The backhoe of claim 11 including a first cover secured to the one side of the yoke and a second cover secured to the other side of the yoke and splined to the rotor.

13. The backhoe of claim 12 wherein the trunnion member includes a pair of bosses, a pair of bushings mounted on the bosses, the yoke including a pair of ring-like bearing portions rotatable on the bushings.

14. The backhoe of claim 13 wherein the yoke is split into two halves and including dowel means securing the two halves together.

15. In a backhoe, a jib boom, a yoke, a bucket pivotally mounted on the yoke on a predetermined generally horizontal pivot axis, adjustable means mounting the yoke pivotally on the jib boom for movement on a horizontal second pivot axis transverse to said predetermined pivot axis, crowd cylinder drive means connected to the boom, and means including a universal joint connecting the crowd cylinder drive means to the bucket.

* * * * *